US006723959B2

(12) United States Patent
Heinz et al.

(10) Patent No.: US 6,723,959 B2
(45) Date of Patent: Apr. 20, 2004

(54) PROCESS FOR JOINING OF A HEATING ROD AND THE BODY OF A GLOW PLUG

(75) Inventors: Rudi Heinz, Remseck (DE); Rainer Uain, Steinheim (DE)

(73) Assignee: BERU AG, Ludwigshafen (DE)

( * ) Notice: Subject to any disclaimer, the term of this patent is extended or adjusted under 35 U.S.C. 154(b) by 0 days.

(21) Appl. No.: 09/933,817

(22) Filed: Aug. 22, 2001

(65) Prior Publication Data

US 2002/0036193 A1 Mar. 28, 2002

(30) Foreign Application Priority Data

Aug. 22, 2000 (DE) ..... 100 41 282

(51) Int. Cl.[7] ..... F23Q 7/00
(52) U.S. Cl. ..... 219/270; 123/145 A
(58) Field of Search ..... 219/270, 544; 123/145 A, 145 R; 29/611, 613; 361/264–266

(56) References Cited

U.S. PATENT DOCUMENTS 4,087,904 A * 5/1978 Steinke et al. ..... 29/611
5,084,607 A * 1/1992 Shafer et al. ..... 219/270
5,589,091 A * 12/1996 Muller ..... 219/270
5,882,233 A * 3/1999 Idehara ..... 439/877
6,252,200 B1 * 6/2001 Heinz et al. ..... 219/270
2002/0195443 A1 * 12/2002 Tanaka et al. ..... 219/544

FOREIGN PATENT DOCUMENTS

| | | | | |
|---|---|---|---|---|
| AU | 230210 | * 12/1959 | ..... | 123/145 A |
| DE | 19752920 | * 6/1999 | | |
| EP | 0 903 541 | 3/1999 | | |
| EP | 1158245 | * 11/2001 | | |
| EP | 1 158 245 | 11/2001 | | |
| JP | 54-82533 | * 6/1979 | | |
| JP | 58-22 | * 1/1983 | ..... | 219/270 |
| JP | 64-46520 | * 2/1989 | | |
| JP | 4-28922 | * 1/1992 | ..... | 219/270 |
| JP | 4-80521 | * 3/1992 | | |

* cited by examiner

*Primary Examiner*—John A. Jeffery
(74) *Attorney, Agent, or Firm*—Nixon Peabody LLP; David S. Safran

(57) ABSTRACT

A glow plug and a process for joining a heating rod of a glow plug to a glow plug body such that a centered force fit between the heating rod and the glow plug body is produced by the radial force acting on the glow plug body.

4 Claims, 2 Drawing Sheets

PROCESS FOR JOINING OF A HEATING ROD AND THE BODY OF A GLOW PLUG

BACKGROUND OF THE INVENTION

1. Field of the Invention

The invention relates to a process for joining the heating rod of a glow plug to a glow plug body.

2. Description of the Prior Art

Joining the heating rod of a glow plug to its glow plug body by pressing the heating rod into the body was known beforehand. To do this a hydraulic pressing means is used which produces a central force fit between the heating rod and the body. Conventionally, the heating rod is pressed axially from the combustion space-side glow plug tip into the glow plug body. The axial force on the tip of the heating rod necessary to do this is highly dependent on the tolerances of the hole in the body and the heating rod diameter as well as the respective surface composition. Since the amount of projection of the heating rod from the glow plug body is an important parameter of the function of the glow plug in installation and engine operation, the press path during installation must be monitored; due to the high pressing force especially in thin and comparatively long heating rods there is the danger of damage of the heating rod by buckling, tilting, striation and deformation so that the pressing force may not exceed the predetermined maximum value. Therefore, the pressing force must also be monitored during the pressing process.

Monitoring of the force-path is technically complex, the long pressing path, associated with the high pressing forces, entailing the enumerated risks; for coated heating rods in addition the coating is destroyed.

The indicated defects of the known production process occur increasingly as glow plugs become smaller with respect to the diameter of their heating rod and glow plugs become longer overall; this in turn promotes construction of space-saving engines. Likewise, one possible new process will enable smaller deviations from concentricity; similarly the process will also be usable for coated heating rods.

SUMMARY OF THE INVENTION

A primary object in accordance with the present invention is achieved by the process of joining the heating rod of a glow plug to its glow plug body in which a centered force fit between the heating rod and the glow plug body is produced by the radial force acting on the glow plug body.

DETAILED DESCRIPTION OF THE INVENTION

Figure 1:
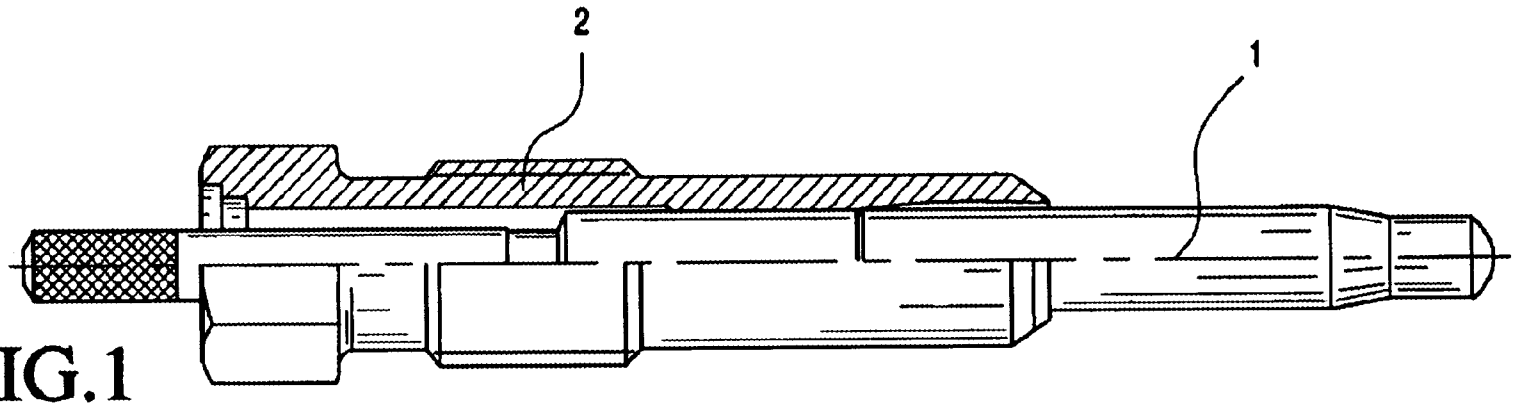
FIG. 1 is a schematic longitudinal section through a glow plug before joining the beating rod to the glow plug body.

As shown in FIG. 1, the heating rod 1 is held positioned centrally in the body 2, for example, by insertion. The diameter of the heating rod 1 and the hole in the body 2 is matched to one another accordingly so that the insertion can take place with a small force. Here, the heating rod 1 is easily aligned axially, in addition, the heating rod 1 is positioned very accurately with the smallest length tolerances axially to the desired amount of projection with respect to the body 2.

Figure 2:
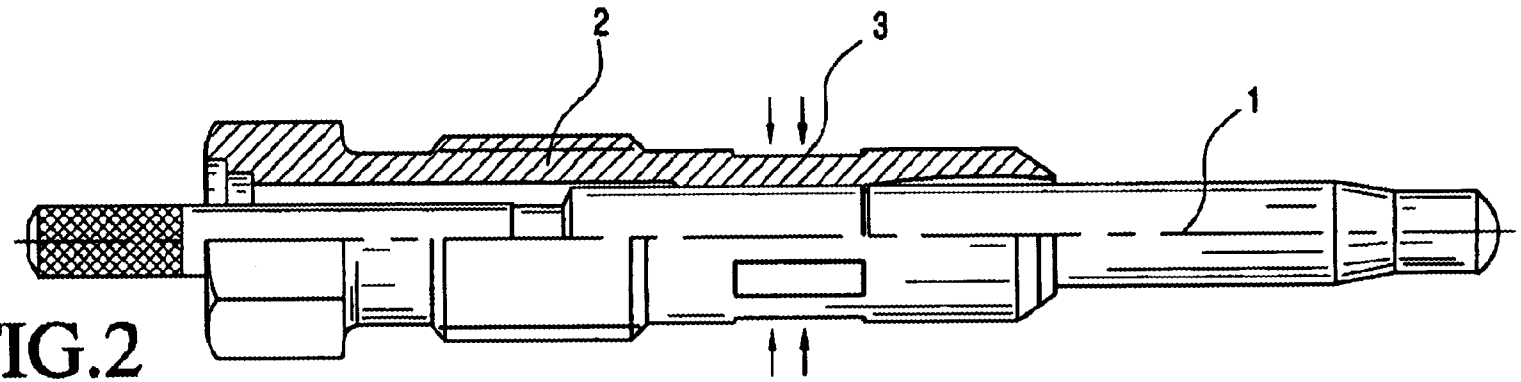
FIG. 2 shows a schematic lengthwise section through the glow plug as shown in FIG. 1 after joining the heating rod and the glow plug body.
Figure 3:
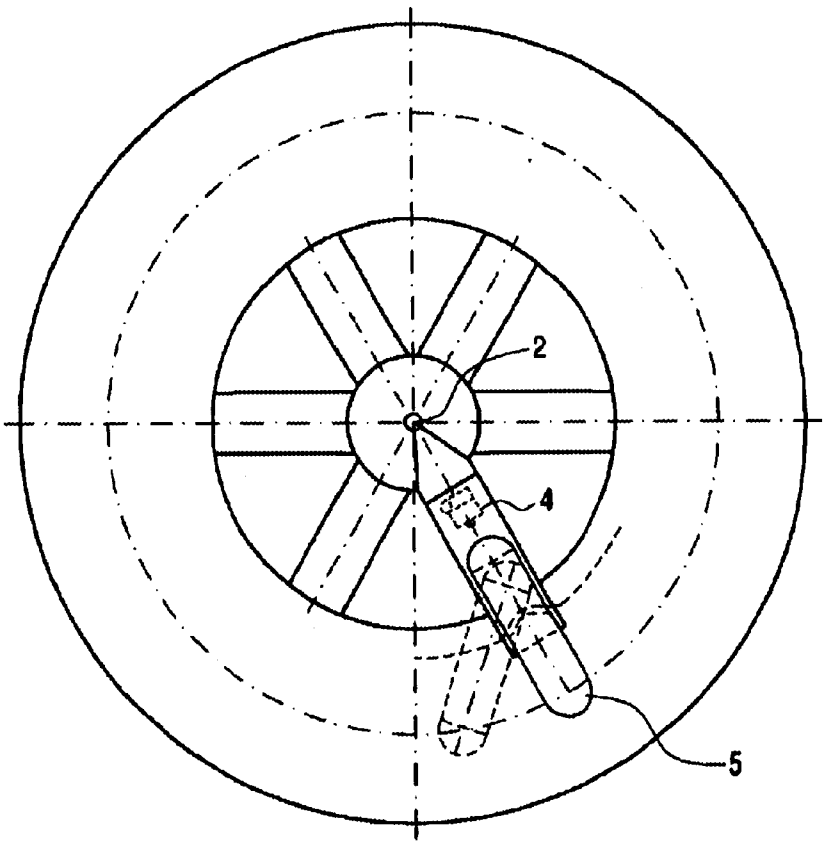
FIG. 3 shows a schematic of a tool for the process in accordance with the present invention.

As shown in FIG. 2, the glow plug body 2 is crimped over the heating rod 1 in the crimp area 3, for example, by way of a crimping tool as shown in FIG. 3. Preferably, the crimp area extends axially over a length of roughly 20 mm. In the crimping process in this area the diameter of the body 2 is reduced. Preferably, crimping is done roughly in the middle over the area of the heating rod 1 which is located within the body 2. The crimping tool as shown in FIG. 3 has a rotary disk, six crimping jaws 4 and a feather key 5.

It was ascertained in tests that in glow plugs which were produced using the inventive process concentricity is very accurate; damage to the heating rod, such as kinking or deformation, did not occur. For coated heating rods the coating remained undamaged. In the simple process force-path monitoring is unnecessary, the forces which are being transmitted radially as claimed in the invention overall entailing fewer production engineering risks.

What is claimed is:

1. A process for joining a heating rod of a glow plug to a glow plug body, said process comprising:

crimping by way of a crimping tool producing a radial force acting on the glow plug body in a crimp area of the glow plug body over the heating rod, wherein the diameter of the glow plug body is reduced in the crimp area and the crimp area forms an axially and circumferentially elongate, continuously contacting compression joint between the inner surface of the glow plug body and the outer surface of the heating rod such that the heating rod is held centrally in the glow plug body by compressive radial forces without form-fitting deformation and wherein the crimping takes place approximately in the middle of the area of the heating rod surrounded by the glow plug body.

2. The process as claimed in claim 1, wherein the crimp area has an axial extension of about 20 mm.

3. The process as claimed in claim 1, wherein said crimping tool having a plurality of crimping jaws and a feather key.

4. A glow plug, comprising:

a heating rod; and a glow plug body, wherein the heating rod is centrally located within the glow plug body which surrounds the heating rod and the glow plug body is joined to the heating rod by crimping the glow plug body in a crimp area which forms an axially and circumferentially elongate, continuously contacting compression joint between the inner surface of the glow plug body and the outer surface of the heating rod approximately in a middle of area of the heating rod surrounded by the glow plug body such that the glow plug body has a reduced diameter in the crimped area and is joined to the heating rod by radial compression without form-fitting deformation.

* * * * *